US012618250B2

(12) United States Patent
Wells

(10) Patent No.: US 12,618,250 B2
(45) **Date of Patent: *May 5, 2026**

(54) TEMPORARY PROTECTIVE WALL PARTITION BARRIER SYSTEM FOR USE DURING CONSTRUCTION AND DEMOLITION

(71) Applicant: Simon Wells, Fort Lauderdale, FL (US)

(72) Inventor: Simon Wells, Fort Lauderdale, FL (US)

( * ) Notice: Subject to any disclaimer, the term of this patent is extended or adjusted under 35 U.S.C. 154(b) by 248 days.

This patent is subject to a terminal disclaimer.

(21) Appl. No.: 18/533,806

(22) Filed: Dec. 8, 2023

(65) Prior Publication Data

US 2024/0263467 A1 Aug. 8, 2024

Related U.S. Application Data

(60) Continuation-in-part of application No. 18/238,106, filed on Aug. 25, 2023, now Pat. No. 11,851,899, which is a division of application No. 18/138,052, filed on Apr. 22, 2023, now Pat. No. 11,814,854, and a continuation-in-part of application No. 18/105,814, filed on Feb. 4, 2023, now Pat. No. 12,234,660.

(51) Int. Cl.
*E04G 21/30* (2006.01)

(52) U.S. Cl.
CPC ..... *E04G 21/30* (2013.01)

(58) Field of Classification Search
CPC ... E04G 21/30; E04G 21/3209; E04G 21/243; E04F 13/075
See application file for complete search history.

(56) References Cited

U.S. PATENT DOCUMENTS 3,895,981 A * 7/1975 Tesch ..... E04F 11/163 52/181
5,768,829 A * 6/1998 Thompson ..... E04G 21/3209 52/79.5
6,640,501 B1 * 11/2003 Hussey ..... E04G 21/30 52/177
6,996,860 B1 * 2/2006 Blake ..... A47K 3/001 4/504
7,228,668 B2 * 6/2007 Gibney ..... E04G 21/30 52/211
7,749,588 B2 * 7/2010 Blake ..... B32B 29/08 428/184

(Continued)

*Primary Examiner* — Rodney Mintz
(74) *Attorney, Agent, or Firm* — Melvin K. Silverman

(57) ABSTRACT

The invention disclosed herein also provides a temporary protective containment barrier system for use during construction and demolition, wall members, noggings, ceiling joists, and in some embodiments, horizontal floor panels positioned perpendicularly at a lower boundary of the vertical wall panel, a temporary protection system for a stair, and free-standing tunnel modules. Each wall member includes one vertical wall panels secured to an interior area of a vertically adjustable stud member, thereby creating a vertical partition. Wall members are comprised of vertically adjustable stud members, each with an outward cantilever integrated at an upper boundary. The outward cantilever extends perpendicularly away from each adjustable stud. Each vertically adjustable stud member is connectable to a neighboring stud member by the noggings. Each outward cantilever is connectable to a neighboring outward cantilever by ceiling joists.

22 Claims, 14 Drawing Sheets

(56) References Cited

U.S. PATENT DOCUMENTS 7,823,332 B2 * 11/2010 Siegel ..... A47G 27/0287 52/177
8,839,592 B2 * 9/2014 Foran ..... E04G 21/243 52/796.1
9,091,073 B2 * 7/2015 Wells ..... E04F 15/02
9,732,533 B2 * 8/2017 Ruzhin ..... E04G 21/30
9,945,137 B2 * 4/2018 Prest ..... E04G 21/30
9,956,568 B2 * 5/2018 O'Brien ..... B05C 21/005
10,570,623 B1 * 2/2020 Wells ..... E04F 11/17
10,676,939 B2 * 6/2020 Wells ..... E04G 21/30
10,731,339 B2 * 8/2020 Hauserman-Winder ..... E04B 2/7453
10,907,367 B2 * 2/2021 Dixon ..... E04G 1/18
11,002,028 B2 * 5/2021 Rus ..... E04G 21/30
11,149,452 B2 * 10/2021 Rus ..... E04G 21/30
11,293,193 B2 * 4/2022 Rus ..... E04F 11/163
11,486,156 B2 * 11/2022 Rus ..... E04F 11/163
11,634,918 B1 * 4/2023 McQuade ..... B05B 12/22 5/420
11,814,854 B1 * 11/2023 Wells ..... E04G 21/3209
11,851,899 B1 * 12/2023 Wells ..... E04G 21/30
12,054,942 B2 * 8/2024 Bickford ..... E04B 2/7411
12,091,871 B2 * 9/2024 Wells ..... E04G 21/30
12,234,660 B2 * 2/2025 Wells ..... B63B 83/00
2003/0196387 A1 * 10/2003 Hussey ..... E04G 21/30 52/3
2004/0261344 A1 * 12/2004 Gibney ..... E04G 21/30 52/506.01
2004/0261346 A1 * 12/2004 Gibney ..... E04G 21/30 52/506.01
2005/0223650 A1 * 10/2005 Blake ..... E04G 21/30 52/3
2008/0066389 A1 * 3/2008 Siegel ..... A47G 27/0287 52/3
2010/0255770 A1 * 10/2010 Blake ..... B32B 3/12 454/367
2013/0236676 A1 * 9/2013 Doyle ..... E04G 21/30 428/57
2014/0033642 A1 * 2/2014 Foran ..... E04G 21/30 52/782.1
2014/0157712 A1 * 6/2014 Wells ..... E04G 21/30 52/796.1
2015/0056401 A1 * 2/2015 Farah ..... B32B 37/22 156/547
2016/0312484 A1 * 10/2016 Ruzhin ..... E04G 21/30
2017/0183883 A1 * 6/2017 Rus ..... E04G 21/30
2017/0189925 A1 * 7/2017 O'Brien ..... B05C 21/005
2018/0347205 A1 * 12/2018 Rus ..... E04F 11/166
2018/0347215 A1 * 12/2018 Rus ..... E04G 21/30
2018/0347216 A1 * 12/2018 Rus ..... E04F 11/104
2018/0353051 A1 * 12/2018 Clark ..... A47L 13/10
2019/0085572 A1 * 3/2019 Rus ..... E04G 21/30
2019/0186129 A1 * 6/2019 Hauserman-Winder ..... E04B 2/7453
2020/0040585 A1 * 2/2020 Wells ..... E04F 11/163
2020/0123781 A1 * 4/2020 Wells ..... E04F 11/1045
2020/0141137 A1 * 5/2020 Dixon ..... E04G 1/18
2020/0332543 A1 * 10/2020 Rus ..... E04F 11/163
2021/0238845 A1 * 8/2021 Bickford ..... B32B 9/041
2022/0178138 A1 * 6/2022 Bickford ..... E04B 2/7448
2024/0263467 A1 * 8/2024 Wells ..... E04G 21/243
2024/0263468 A1 * 8/2024 Wells ..... E04G 21/30
2024/0263469 A1 * 8/2024 Wells ..... B63B 83/00
2024/0337121 A1 * 10/2024 Balbis Farinha ..... E04G 21/30

* cited by examiner

TEMPORARY PROTECTIVE WALL PARTITION BARRIER SYSTEM FOR USE DURING CONSTRUCTION AND DEMOLITION

CROSS-REFERENCE TO RELATED APPLICATIONS

This application is continuation-in-part of Ser. No. 18/238,106, which is a divisional of co-pending application Ser. No. 18/138,052, entitled: "A System and Method for a Temporary Protective Barrier for Floors and Stairs During Construction and Demolition", which is a continuation in part of co-pending application Ser. No. 18/105,814, entitled: "System and Method for a Temporary Protective Structure for Use in Construction and Demolition", filed Feb. 4, 2023, all of which is incorporated by reference in its entirety.

FIELD OF THE INVENTION

The present invention relates temporary structures used in construction and demolition.

BACKGROUND

When the interiors high-end rooms are being refitted, not all surfaces and interiors are demolished. Because these remaining high-end fixtures and surfaces are vulnerable to damage from debris and loose articles from demolition, it is important to include protections against such damage. In general construction and building practices include scaffolding and plastic tarps, typically duct taped together to contain dust. However, this setup does not protect flooring, walls, stairs, and other surfaces from heavier debris, and damage can occur if something is dropped. Typically, builders may include cardboard squares on the floor, however these squares can slide and scrape the floors they're intended to protect. In addition, when leaving these protected areas, there is typically no protection for rooms being left unaltered. That is, the scaffolding, tarps, and cardboard only exist in the construction area.

When the interiors of these high-end rooms of yachts, crafts, buildings, homes, and the like are being refitted, the rooms being demolished and remodeled are typically nestled down a maze of corridors and stairways. My previous inventions disclosed a system to handle these situations. However, when renovating larger spaces, the tunnel systems disclosed in my previous applications are too small to be effective. Thus, a need exists in the market for a temporary protective barrier that is configurable to protect unaltered areas of a structure under renovation and provide enhanced protection for the surfaces outside the barrier so that damage does not occur, as well as partition larger rooms for partial areas of construction.

My previously filed U.S. patent application Ser. No. 18/105,814, entitled "A SYSTEM AND METHOD FOR A TEMPORARY PROTECTIVE STRUCTURE FOR USE IN CONSTRUCTION AND DEMOLITION" disclosed a system and method of a temporary protective structural system that focused on the overall system employed. That system includes a plurality of frame members. The frame members define a pair of opposing studs and integrated top plate. The system also includes noggings connecting the studs. Ceiling joists are also included. The combination creates at least one free-standing tunnel module. Vertical wall panels are secured to the exteriors of the free-standing tunnel modules, thereby vertically enclosing the free-standing tunnel modules. Horizontal ceiling panels are secured to an exterior ceiling area of the tunnel modules. Horizontal floor panels provide a protective surface for the floor. When constructed, the combination of elements and tunnel modules create a protective barrier for sensitive surfaces in a construction zone.

My previously filed U.S. patent application Ser. No. 18/138,052, and U.S. patent application Ser. No. 18/238,106, disclose a temporary protective system and method that introduces a floor covering and stair protection system, as well as the method of use and combination with the temporary tunnel system. However, more consideration needs to be given to a wall partition systems that may be easily applied to larger rooms where only a particular area is being worked. The disclosure herein provides the solution for this problem in an easily executable configuration.

SUMMARY OF THE INVENTION

The invention disclosed herein provides a temporary protective containment barrier system for use during construction and demolition. The temporary protective containment barrier system for use during construction and demolition comprises a plurality of wall members. Each wall member in the plurality of wall members includes at least one vertical wall panel secured to an interior area of a vertically adjustable stud member, thereby creating a vertical partition. The plurality of wall members is comprised of a plurality of the vertically adjustable stud members, each with an outward cantilever integrated at an upper boundary, wherein the outward cantilever extends perpendicularly away from each adjustable stud member in a direction opposite of a side on which the at least one vertical wall panel is secured to. The system also includes a plurality of noggins. Each vertically adjustable stud member in the plurality of vertically adjustable stud members is connectable to a neighboring stud member by the plurality of noggings. The system further includes at least one ceiling joist. Each outward cantilever in the plurality of vertically adjustable stud members is connectable to a neighboring outward cantilever by at least one ceiling joist.

The invention disclosed herein also provides a temporary protective containment barrier system for use during construction and demolition. The temporary protective containment barrier system for use during construction and demolition comprises a plurality of wall members. Each wall member in the plurality of wall members includes at least one vertical wall panel secured to an interior area of a vertically adjustable stud member, thereby creating a vertical partition. The plurality of wall members is comprised of a plurality of the vertically adjustable stud members, each with an outward cantilever integrated at an upper boundary, wherein the outward cantilever extends perpendicularly away from each adjustable stud member in a direction opposite of a side on which the at least one vertical wall panel is secured to. The system also includes a plurality of noggings. Each vertically adjustable stud member in the plurality of vertically adjustable stud members is connectable to a neighboring stud member by the plurality of noggings. The system further includes at least one ceiling joist. Each outward cantilever in the plurality of vertically adjustable stud members is connectable to a neighboring outward cantilever by at least one ceiling joist. This embodiment further includes at least one horizontal floor panel positioned perpendicularly at a lower boundary of the at least one vertical wall panel, a temporary protection system for a stair, and at least one free-standing tunnel module.

It is an object of the present invention to provide a system capable of being readily assembled and disassembled with minimal pieces outside the overall system.

It is yet another object of the present invention is to provide a system that can be used to create a partition and a protective barrier on flooring and stairs from a demolition or construction area to the outside of the structure where the threat of damage is no longer present.

It is a further object to provide a system that incorporates cushioned material to shield exposed surfaces of the structure.

Finally, it is an object of the invention to provide a temporary wall barrier capable of thermal insulative properties, noise dampening, and adjustable height and dimensions.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
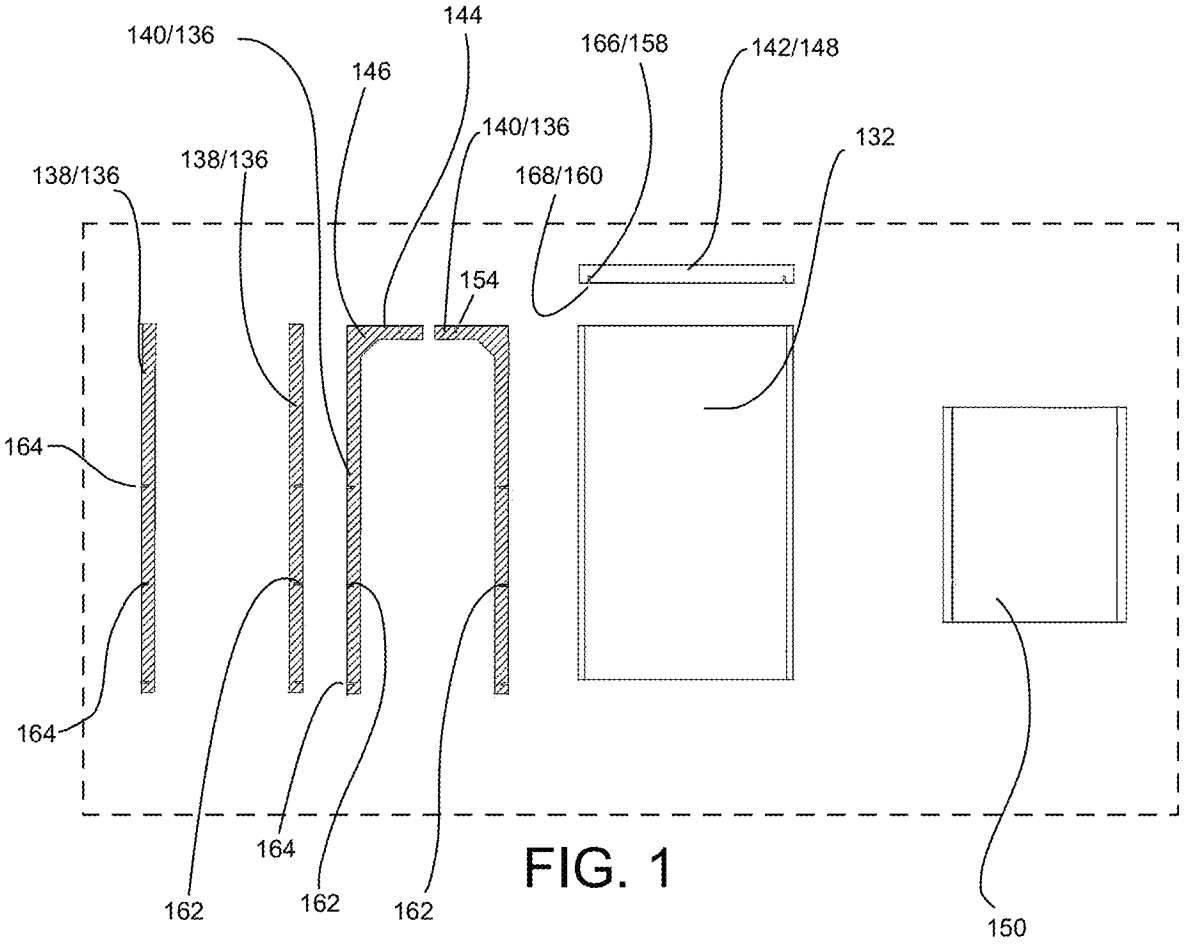
FIG. 1 illustrates a front view of various independent components of the system.

The invention herein provides a solution for protecting and maintaining the safety and integrity of unaltered fixtures and surfaces during demolition and construction. The invention includes a uniquely configured barrier system that focuses on room partitions. This system complements my other inventions, which include coverings for the stairs (both riser and tread), that is customizable in size and volume, and includes an anchor system to protect flooring and stairs during construction and demolition. This system further compliments a frame element system, as I've described in previous patent applications, having members connecting several frame elements to create a frame skeleton. Several protective panels surrounding the skeletal frame are incorporated to provide for protection and containment. This unique arrangement, in combination, is capable of solving the above issues plaguing current methods of protection during construction.

As stated above, when high-end interiors being refitted and renovated, not all surfaces and interiors are demolished. Because these remaining high-end fixtures and surfaces are vulnerable to damage from debris and loose articles from demolition, it is important to include protections against such damage. Some have created systems to address this issue, including scaffolding and plastic tarps, typically duct taped together to contain dust, but these systems do not protect against flying debris, have any sort of insulative properties, and are not modular in nature. Current systems also do not protect flooring, walls, and other surfaces from heavier debris, and damage can occur if something is dropped. Typically, builders may include cardboard squares on the floor, however these squares can slide and scrape the floors they're intended to protect. In addition, when leaving these protected areas, there is typically no protection for rooms being left unaltered. That is, the scaffolding, tarps, and cardboard only exist in the construction area.

To appreciate the current invention, it is also important to understand the context of the overall system. One component of the overall system, as disclosed in my previous U.S. patent application Ser. No. 18/105,814, entitled "A SYSTEM AND METHOD FOR A TEMPORARY PROTECTIVE STRUCTURE FOR USE IN CONSTRUCTION AND DEMOLITION", which is incorporated herein by reference in its entirety, incorporates numerous features to protect the surfaces of the location under renovation. It begins with incorporation of linear protective sheets to cover at least the flooring, as well as sensitive areas like walls, stairs, and railings. These protective sheets are constructed of a plastic material, and arranged with a first upper plastic surface, and a lower plastic surface, connected by plastic fluting thereby providing depth and cushion. The sheets are typically square or rectangular sheets with a linear slice through the first upper plastic sheet and the fluting to allow foldability. However, such sheets may also be cut to size and shape for unique applications. As the sheets are placed around, they are secured to the protected surface by an adhesive. Further, the sheets are then secured to each other by implementing an adhesive tape. Because the sheets are constructed of a plastic material, the incorporation of an adhesive tape creates a water-resistant surface. In addition, are areas of potential slippage, such as stair treads, an adhesive grip is used.

Once the protective sheets are in place, a skeletal frame may be constructed for the tunnel element of the system. The frame incorporates a unitary U-shaped frame element of fluted plastic material to keep the frames light and durable. It is important not to use any heavy materials so as to not pose a thread of damage to the underlying floorspace. The U-shaped frame element includes vertical members, typically called studs in frame construction, and an upper connecting member, known as a top plate in frame construction. The frame includes notches for integrating with other members of the system to provide an easily constructable and de-constructable temporary structure. The U-shaped frame elements are connected to one another by horizontal members, typically called noggings and a plurality of upper horizontal members, typically called ceiling joists. Each component is constructed of the same fluted plastic material for durability and lightness.

The U-shaped frame elements, noggings, and ceiling joists all connect through complemental notches cut into each component. Once pressed into place, the elements for a tunnel module. Footings may also be used to help the modules stand independently. These tunnels are modular and may be arranged in series to provide a continuous tunnel from a starting point inside a construction zone, to an end point beyond areas at risk of damage.

Panels may be installed enclosing the modular tunnel frames once the tunnel frames are secured. These panels provide containment of the contents flowing through the tunnels, and are secured together with adhesive tape so that the tunnels are self-contained. It is to be appreciated that the sheets on the floor, panels forming the ceiling, and panels forming the wall may all the same, thereby reducing the unique number of parts to ensure maximum flexibility and quickness of construction. These panels/sheets are all constructed of fluted plastic material. The fluting ensures cushion to falling objects, while the use of plastic allows the sheets/panels to elastically resume their shape, provide an impermeable water-resistant surface, and are lightweight to provide for ease of construction and avoid potential damage to the floor surface below. By incorporating an adhesive material on each sheet, the sheets can affix to different surfaces, frames, and floors without the explicit need for adhesive tape. This ensures that the sheets/panels do not shift or slip. This aspect offers a significant benefit during construction because panels are not moving while they remain unsecured, and offers a significant benefit for surfaces because they remain in place while the tunnels are in use.

On final construction, the tunnels are sealed off with adhesive tape, and may incorporate plastic zipper doors, thereby sealing the tunnel off from unprotected areas of the construction zone and non-construction zone. Further, junctions of tunnels may be formed as well. Junctions may be sealed off with adhesive tape, and may be open on the inside, or may also contain plastic zipper doors separating individual hallways within the tunnel system.

applications Ser. Nos. 18/138,052, and 18/238,106, both entitled "A SYSTEM AND METHOD FOR A TEMPORARY PROTECTIVE BARRIER FOR FLOORS AND STAIRS DURING CONSTRUCTION AND DEMOLITION", which are both incorporated herein by reference in their entireties incorporates features to protect floors, stairs, and walls during construction and demolition.

In application Ser. No. 18/138,052, the disclosure is directed to a temporary protective barrier system for floors and stairs during construction and demolition. The temporary protective barrier system includes at least one temporary stair tread cover, constructed of fluted plastic material. The system further includes at least one temporary stair riser protector, having a vertically oriented main body with two fold lines running parallel to a width of the main body, wherein once folded, a top folded flap horizontally extends away from the main body, and a bottom folded flap horizontally extends away from the main body in a direction opposite of the direction of the top folded flap, thereby creating an overlap between said top folded flap and an upper stair tread cover of said at least one stair tread cover and an overlap between said bottom folded flap and a lower stair tread cover of said at least one stair tread cover. The system also includes at least a pair of stair anchors configured to directionally secure the stair tread cover, wherein each stair anchor in said pair of stair anchors includes a vertical main body with a horizontal fold line, wherein once folded, a bottom folded flap horizontally extends away from the main body and overlaps said stair tread cover. These elements, in combination with the tunnel construction of the application of Ser. No. 18/105,814 provides a robust protective system.

In application Ser. No. 18/138,052, the disclosure is directed to a method of providing surface protection during at least construction and demolition. The method includes the steps of providing at least one temporary stair tread cover, constructed of fluted plastic, providing at least one temporary stair riser protector, having a vertically oriented main body with two fold lines running parallel to a width of the main body, wherein once folded, a top folded flap horizontally extends away from the main body, and a bottom folded flap horizontally extends away from the main body in a direction opposite of the direction of the top folded flap, thereby creating an overlap between said top folded flap and an upper stair tread cover of said at least one stair tread cover and an overlap between said bottom folded flap and a lower stair tread cover of said at least one stair tread cover, and providing at least a pair of stair anchors configured to directionally secure the stair tread cover, wherein each stair anchor in said pair of stair anchors includes a vertical main body with a horizontal fold line, wherein once folded, a bottom folded flap horizontally extends away from the main body and overlaps said stair tread cover.

The method also includes the steps of measuring a length and height of a stairwell was from a tread to an underside of a handrail, providing a sheet of fluted plastic material forming a wall panel and resting said sheet fluted plastic material on an edge of the treads, and securing the sheet to a wall using the handrail mounting point as an anchor. Further, the method includes measuring a width and depth of the tread, ensuring all treads are equivalent in dimension, and cutting the stair tread cover down to a size equivalent to the width and depth of the tread, if modification is required to match the dimensions. Additionally, the method includes measuring a height of a stair riser, modifying the stair riser protector if a smaller size is required, ensuring two inches of overlap of between the top flap and upper stair tread cover, and two inches of overlap between the bottom flap and bottom stair tread cover, once folded, and installing the stair riser protector on the stair. Finally, the method incudes measuring the width of the tread to confirm its dimension, modifying the stair anchor to assimilate its width with the depth of the tread, modifying the stair anchor's height to conform with a height equivalent to two-inches above the height of the stair riser, wherein the lower two-inches are folded inward and affixed to the stair tread cover, and installing the stair anchor against the wall sheet, securing all overlap points with adhesive tape.

The additions of the disclosure, herein, complement the current solutions I've disclosed, but create a unique solution for larger spaces. When the interiors of high-end spaces are being refitted, the rooms being demolished and remodeled are typically expansive and have a large range of geometric shapes, heights, and overall square footage. While my previously disclosed inventions discuss the modular tunnel system and system and method for covering stairs and floors, this disclosure introduces the unique wall partition structure, capable of insulation, noise dampening, cushioned protection, and a modular and adjustable construction. Thus filling a need exists in the market for a temporary protective barrier for partitioning spaces during construction and demolition that is configurable to protect unaltered foot surfaces of spaces under renovation and provide enhanced protection for the surfaces outside the barrier so that damage does not occur. The current invention solves these problems by utilizing a unique component-based system having several parts, thereby ensuring scalability and customizability to fit each unique application.

The temporary protective wall partition barrier system for use during construction and demolition of the present invention may be used to, among other things, provide a system capable of being readily assembled and disassembled with minimal pieces outside the overall system, provide a system that can be used to create a partition and a protective barrier on flooring and stairs from a demolition or construction area to the outside of the structure where the threat of damage is no longer present, provide a system that incorporates cushioned material to shield exposed surfaces of the structure, and provide a temporary wall barrier capable of thermal insulative properties, noise dampening, and adjustable height and dimensions. This apparatus and system are particularly shown in FIGS. 1-14.

Figure 2:
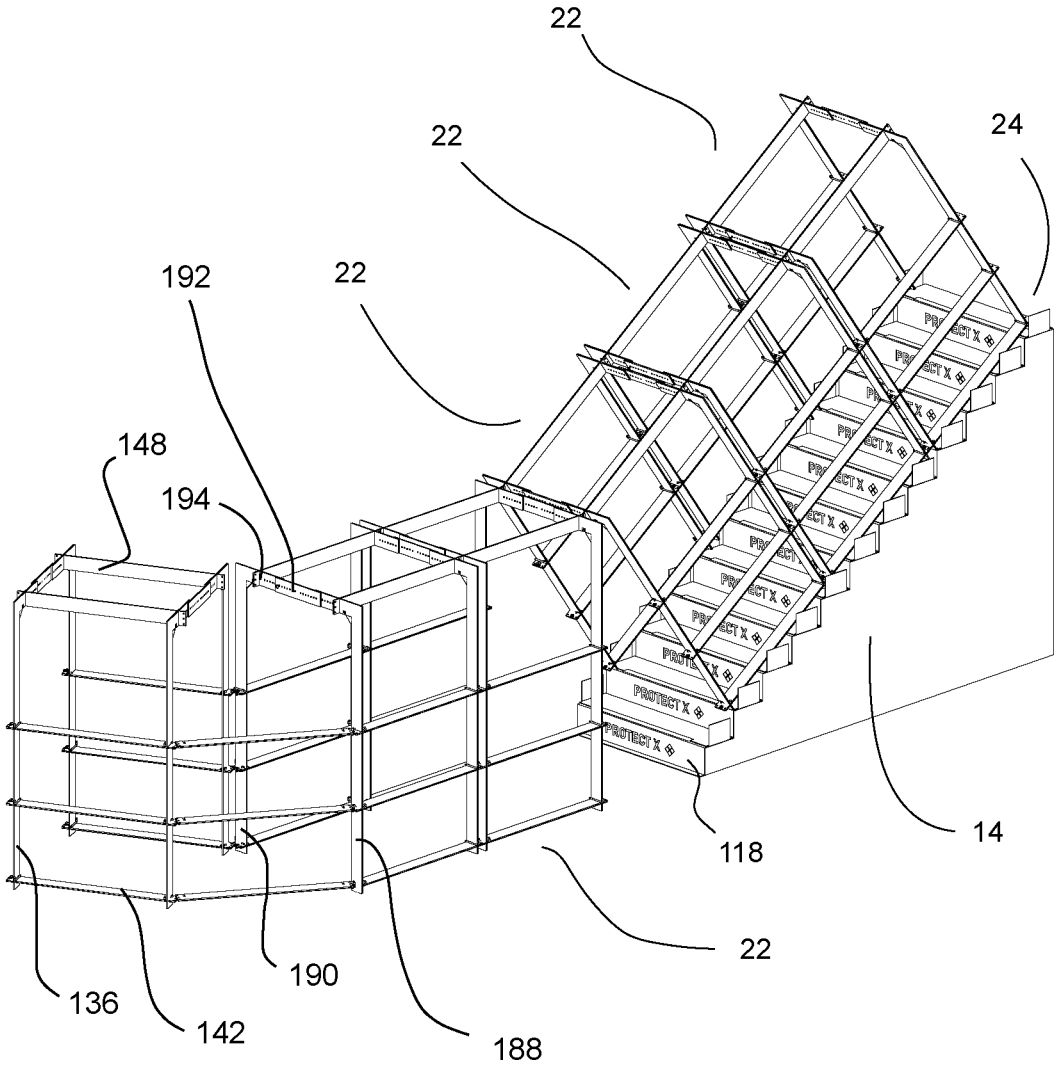
FIG. 2 illustrates an isometric view of the tunnel and stair components of the system.
Figure 3:
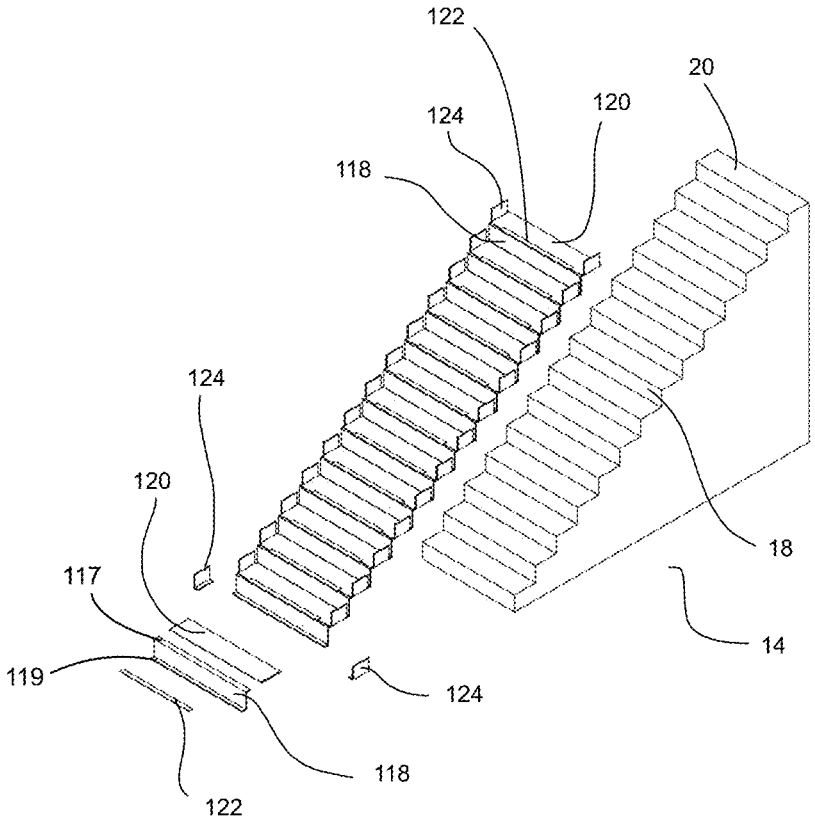
FIG. 3 illustrates an isometric view of a staircase covering system shown in a partially exploded view.
Figure 4:
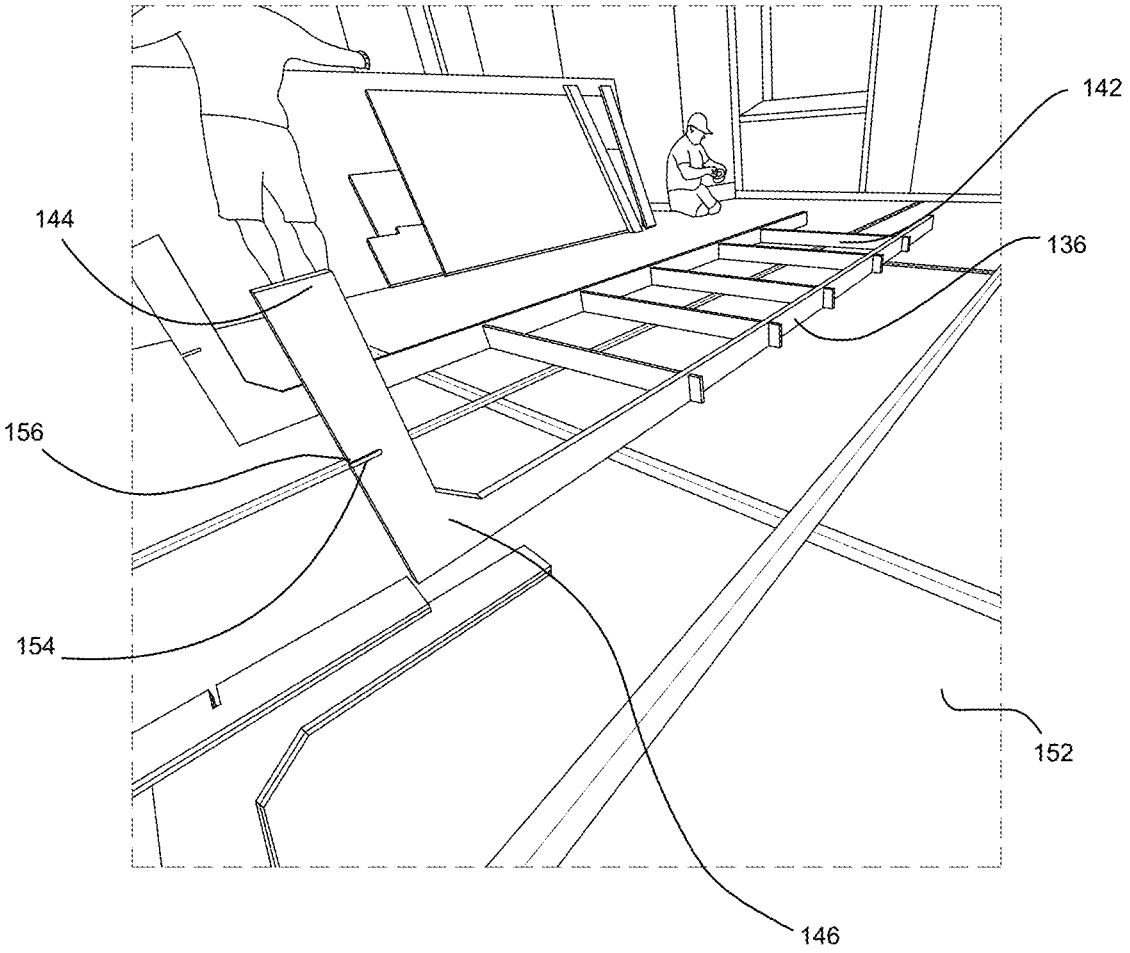
FIG. 4 illustrates a conceptual view of the installation and assembly of the system.
Figure 5:
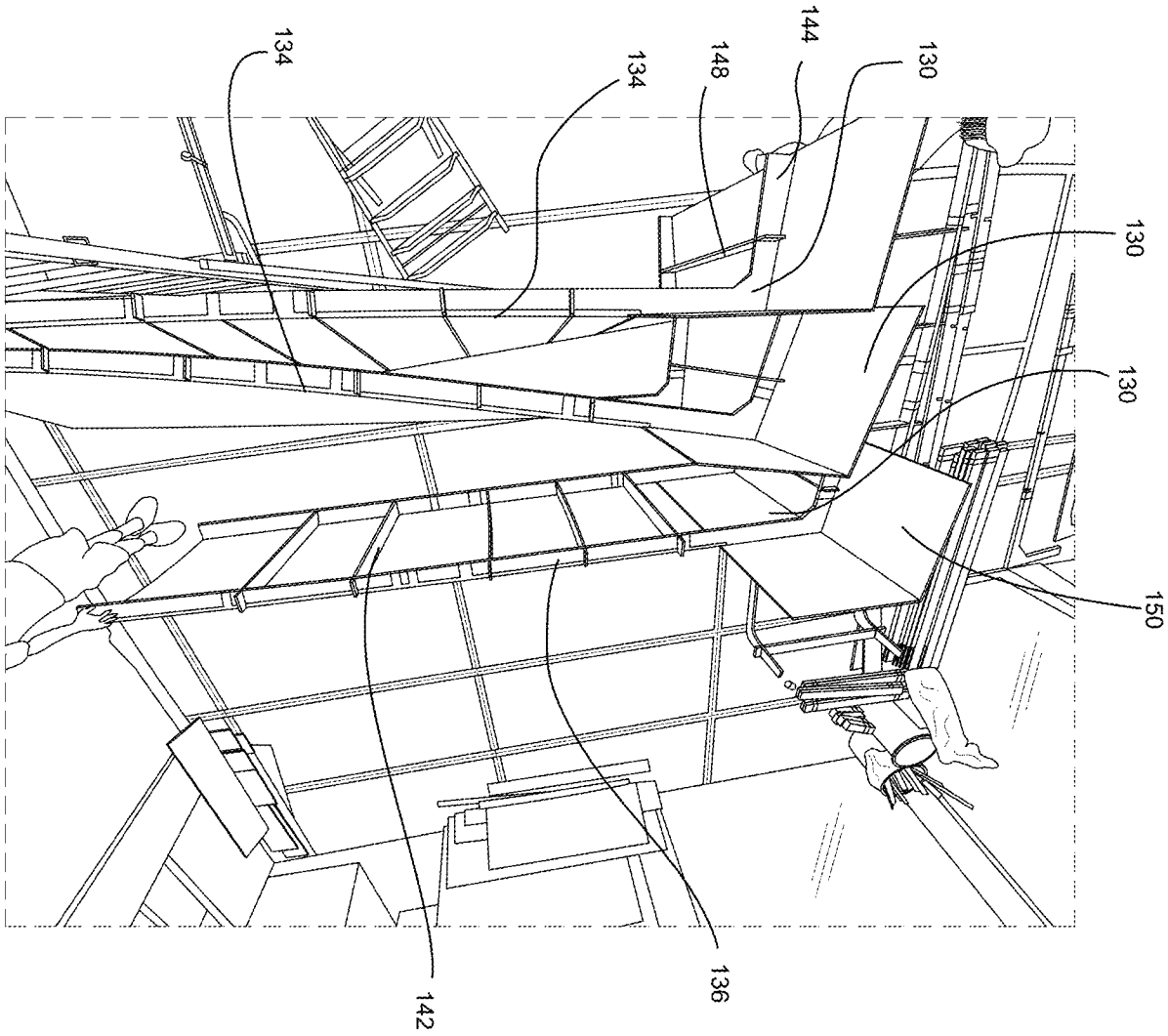
FIG. 5 illustrates a conceptual view of the installation and assembly of the system.
Figure 6:
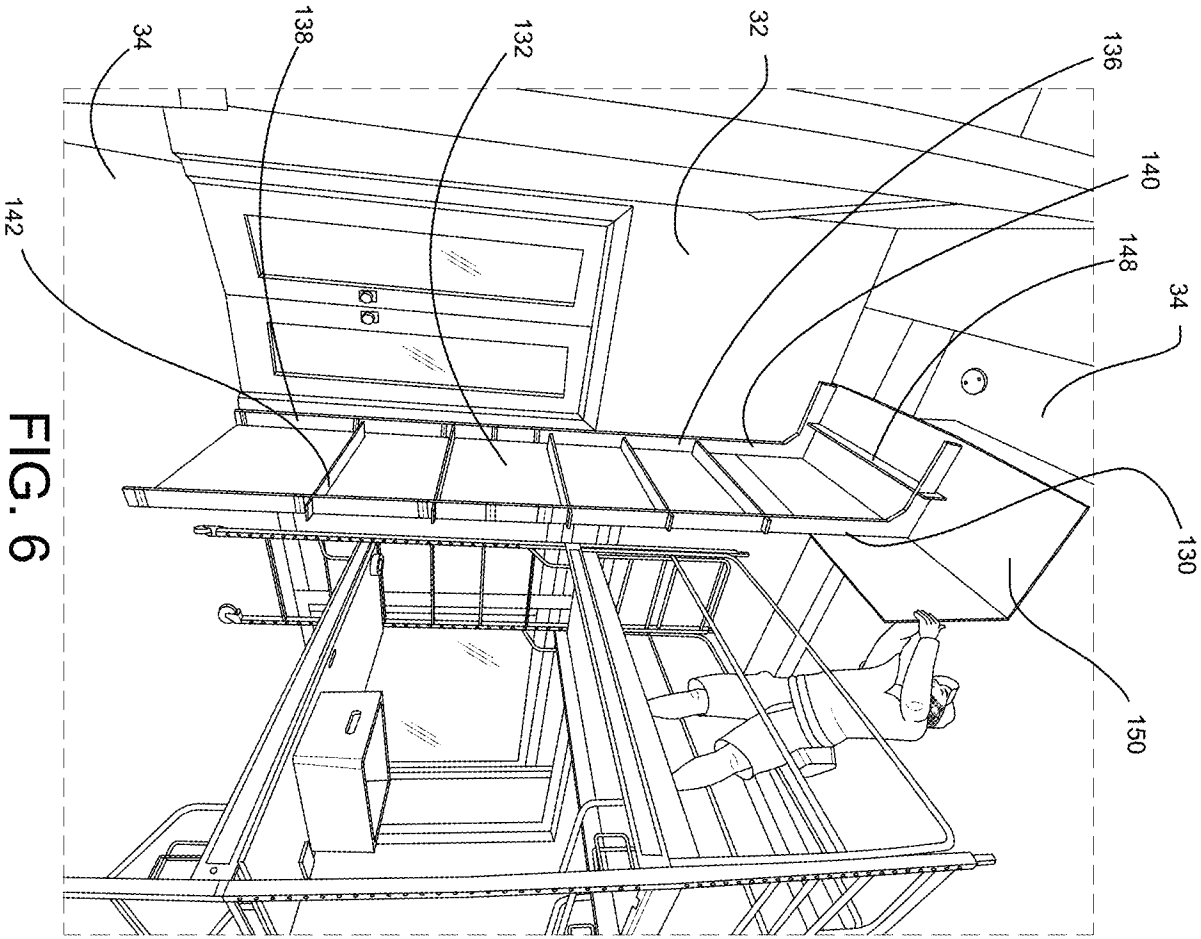
FIG. 6 illustrates a conceptual view of the installation and assembly of the system.
Figure 7:
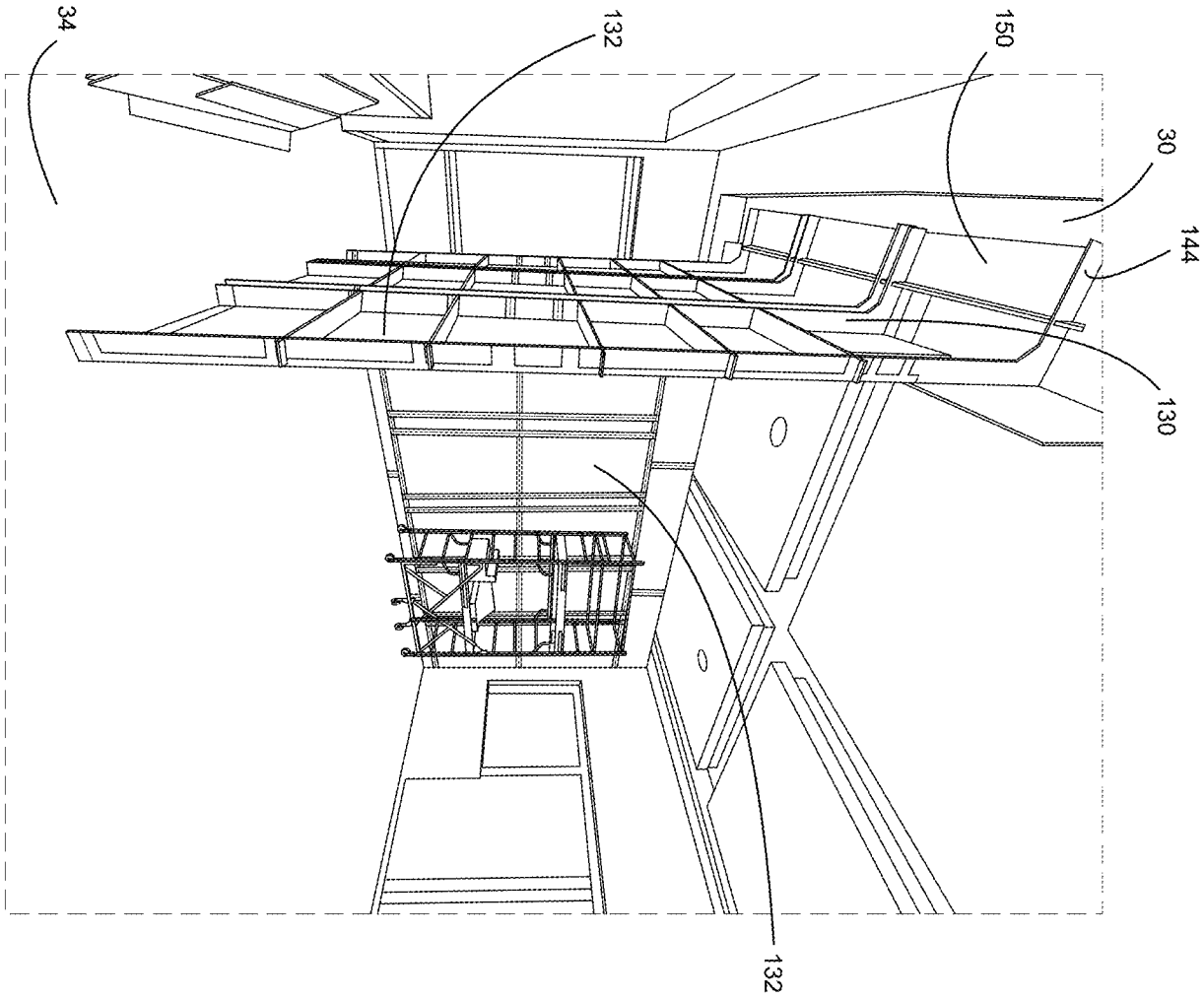
FIG. 7 illustrates a perspective view of the system partially installed in a large room.
Figure 8:
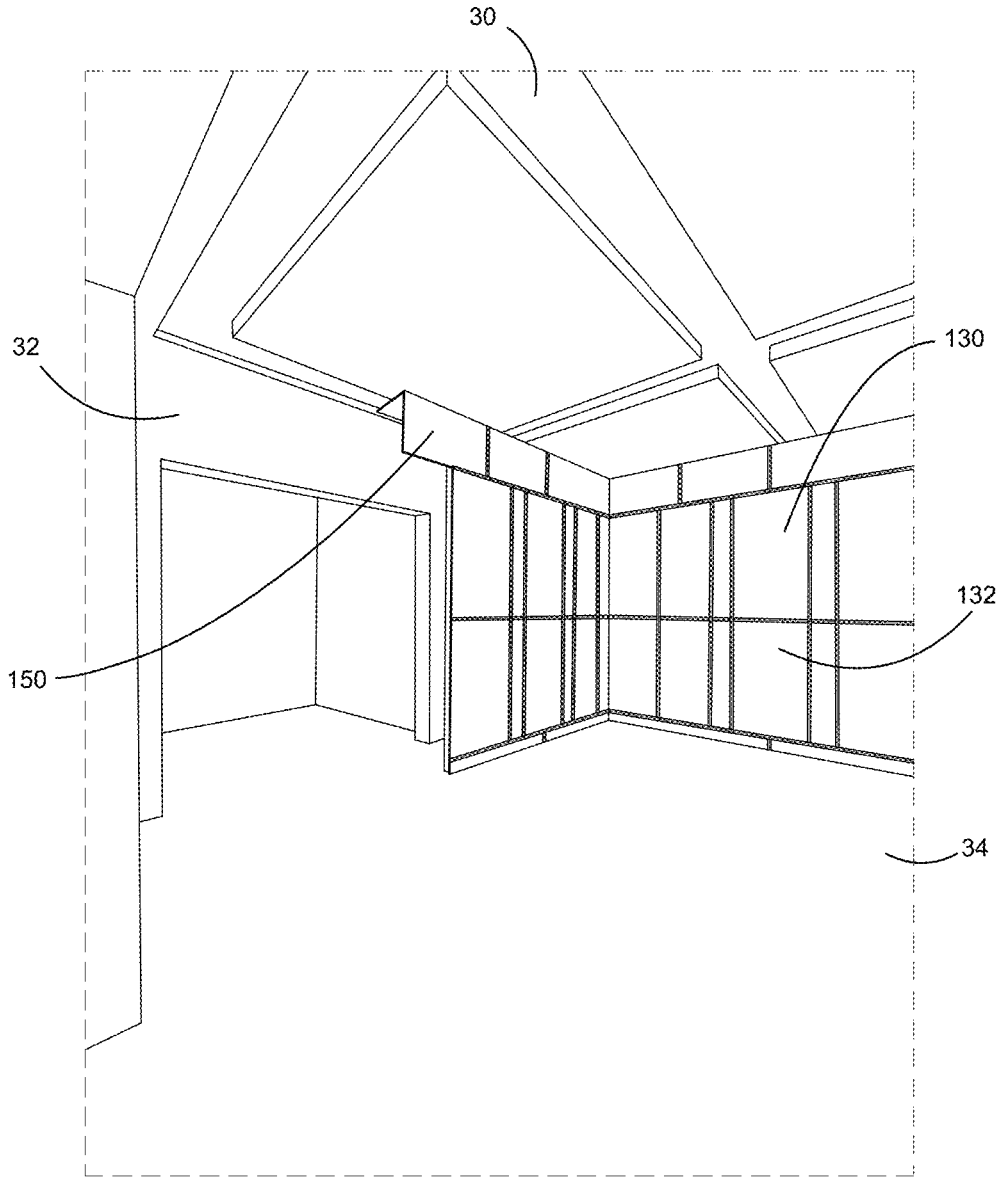
FIG. 8 illustrates a perspective view of the system partially installed in a large room.
Figure 9:
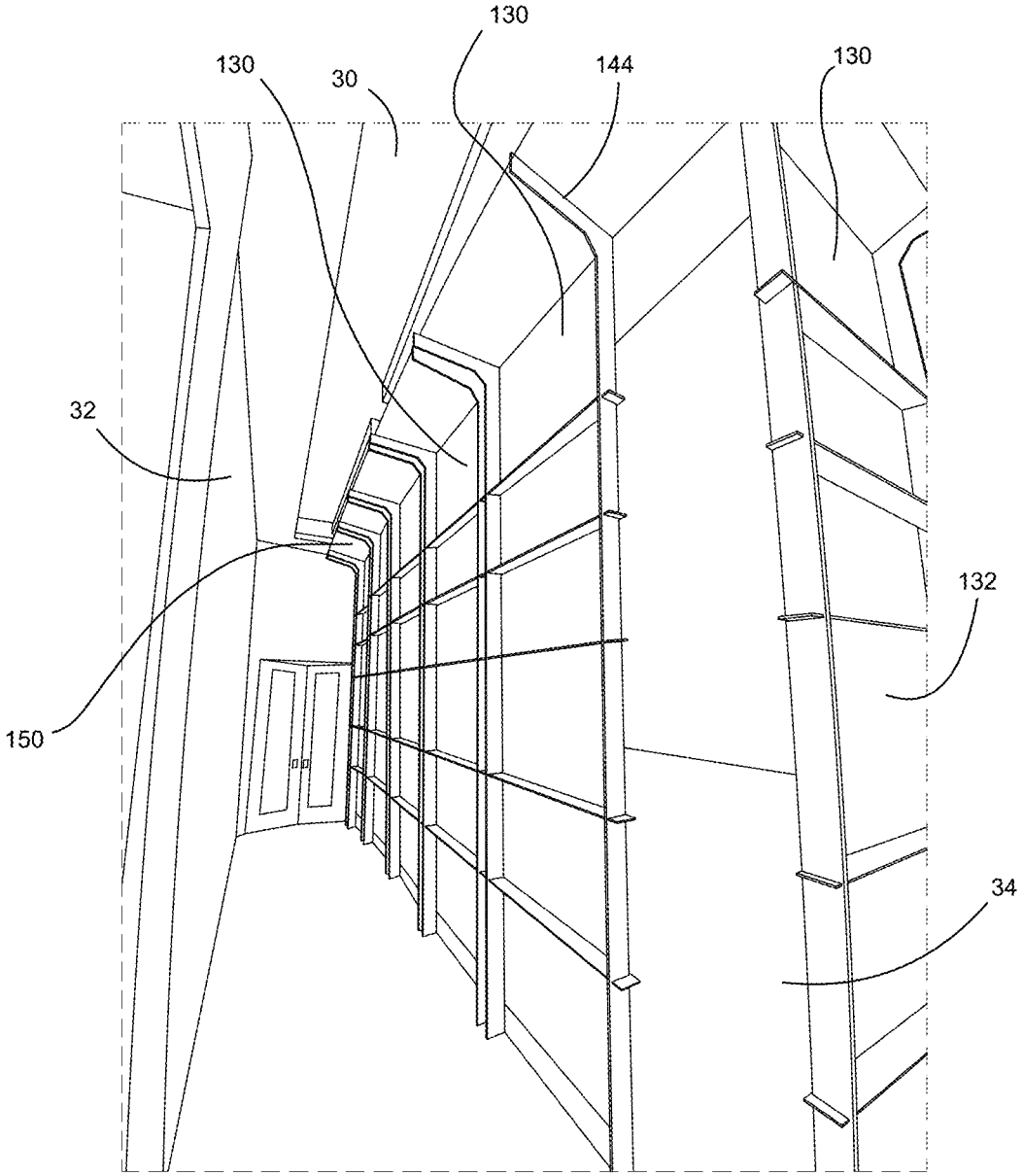
FIG. 9 illustrates a perspective view of the system partially installed in a large room.
Figure 10:
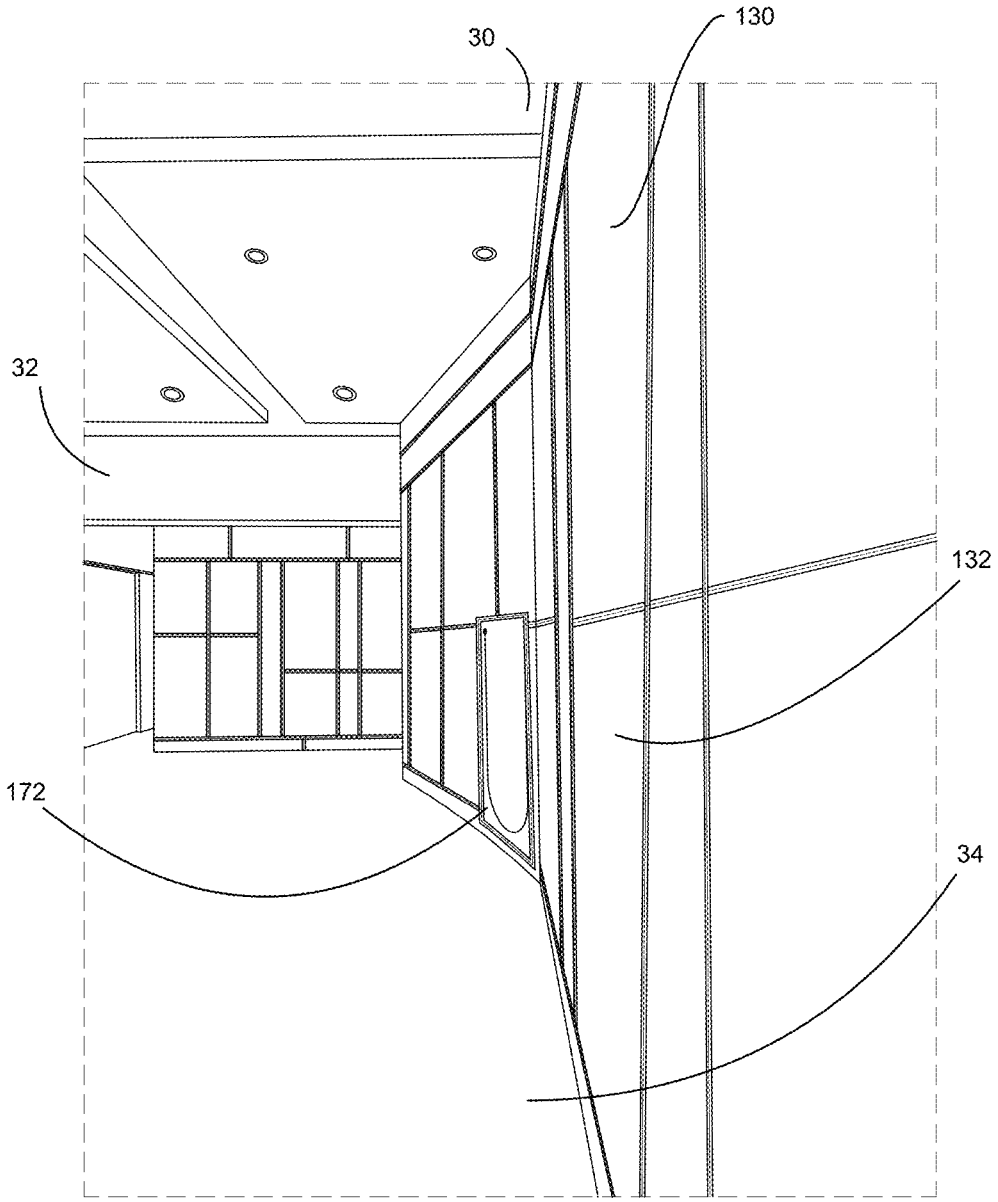
FIG. 10 illustrates a perspective view of the system installed in a large room.
Figure 11:
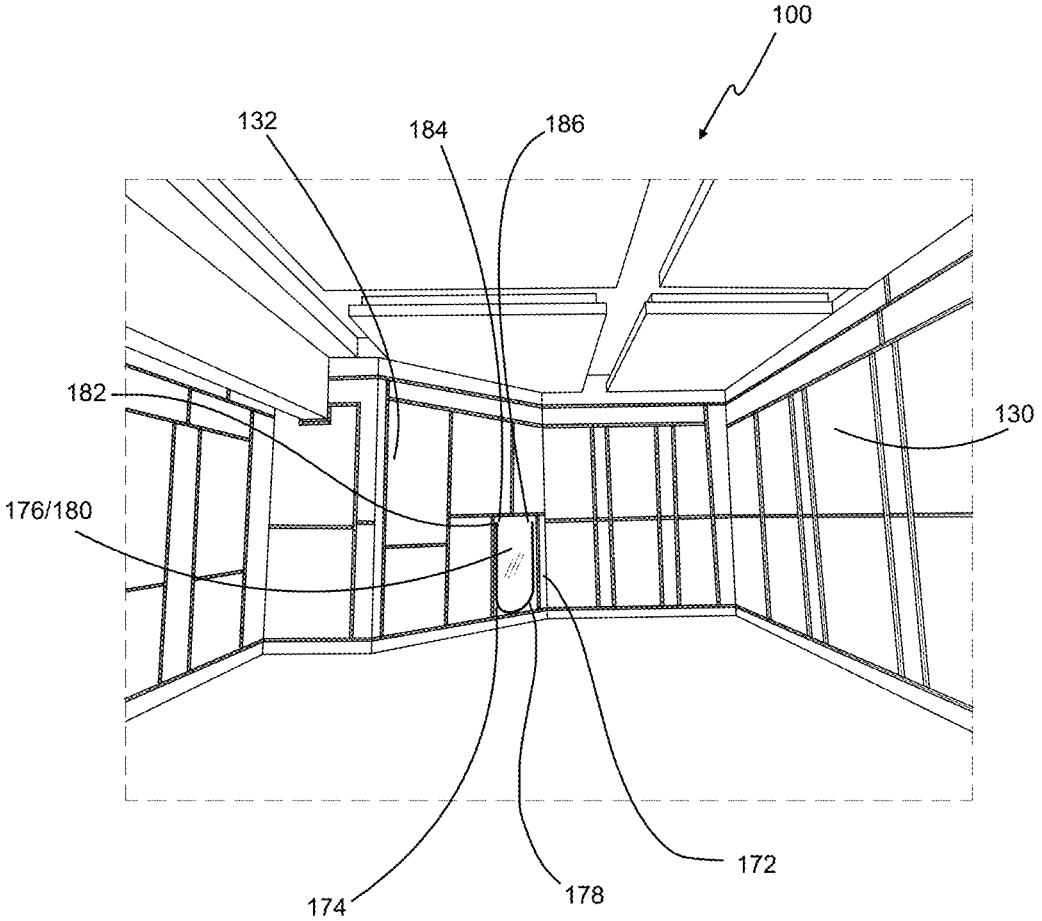
FIG. 11 illustrates a perspective view of the system installed in a large room.
Figure 12:
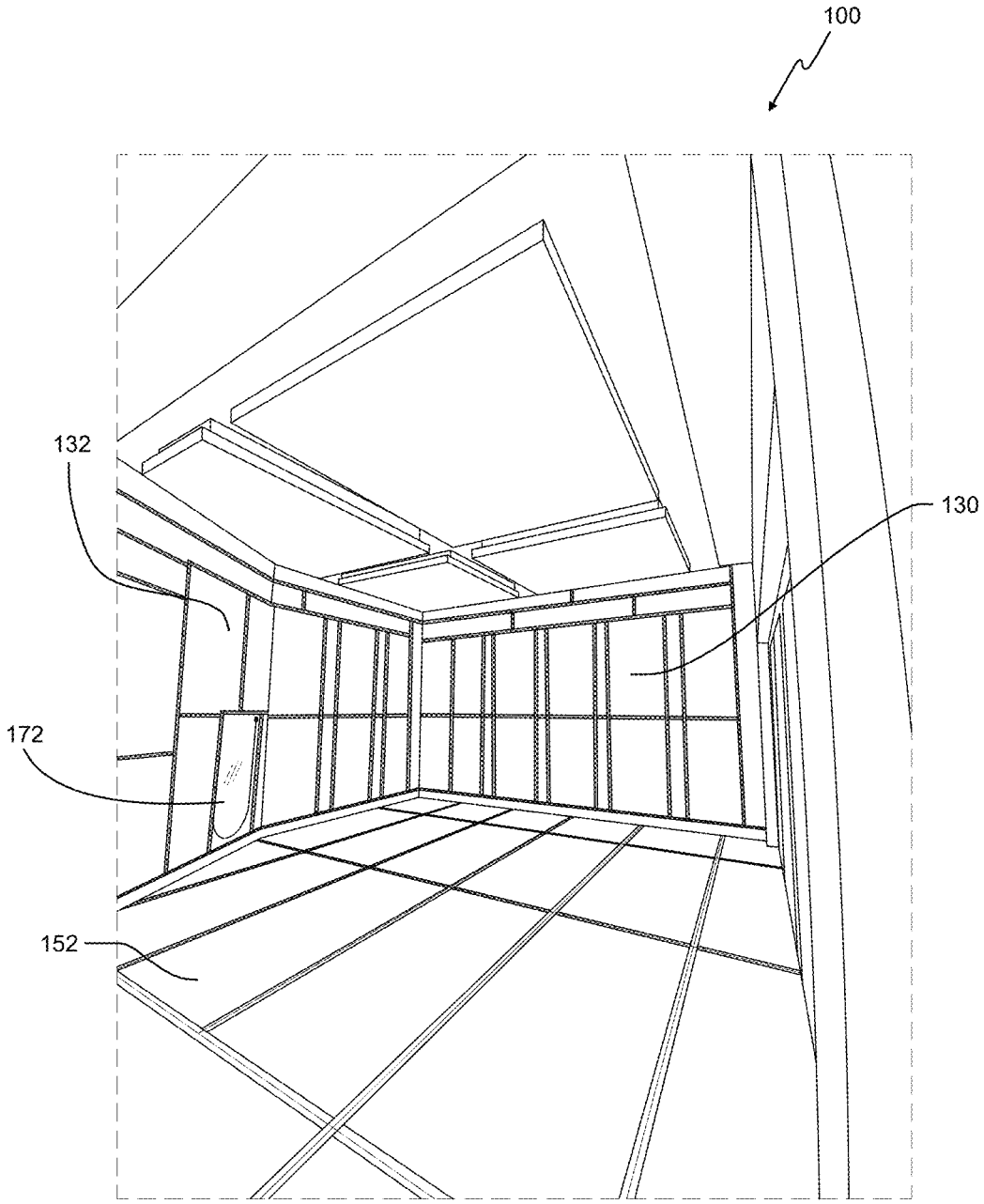
FIG. 12 illustrates a perspective view of the system installed in a large room.
Figure 13:
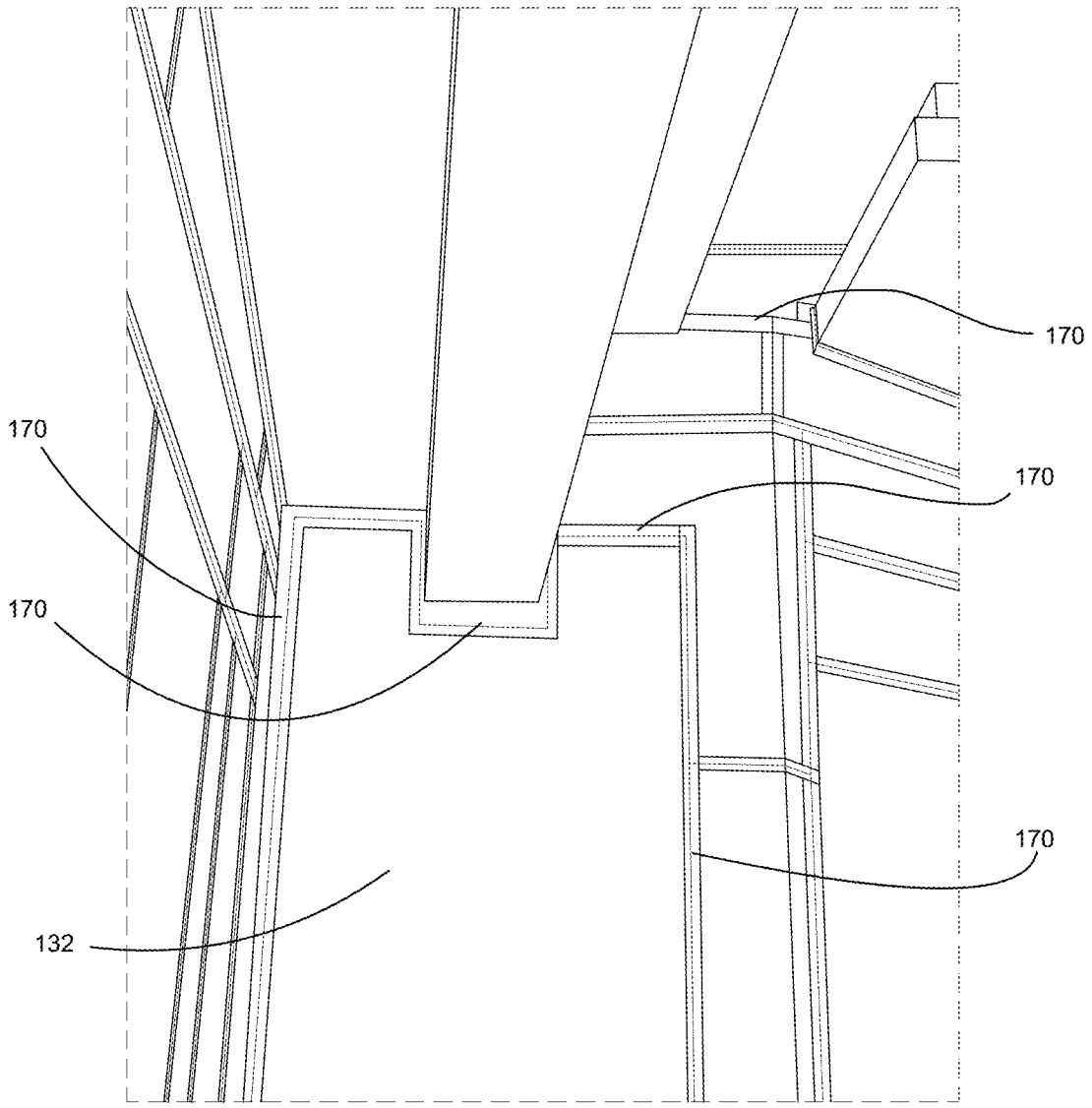
FIG. 13 illustrates an enlarged conceptual view of a unique configuration of components to integrate with structural and architectural features of a large room.
Figure 14:
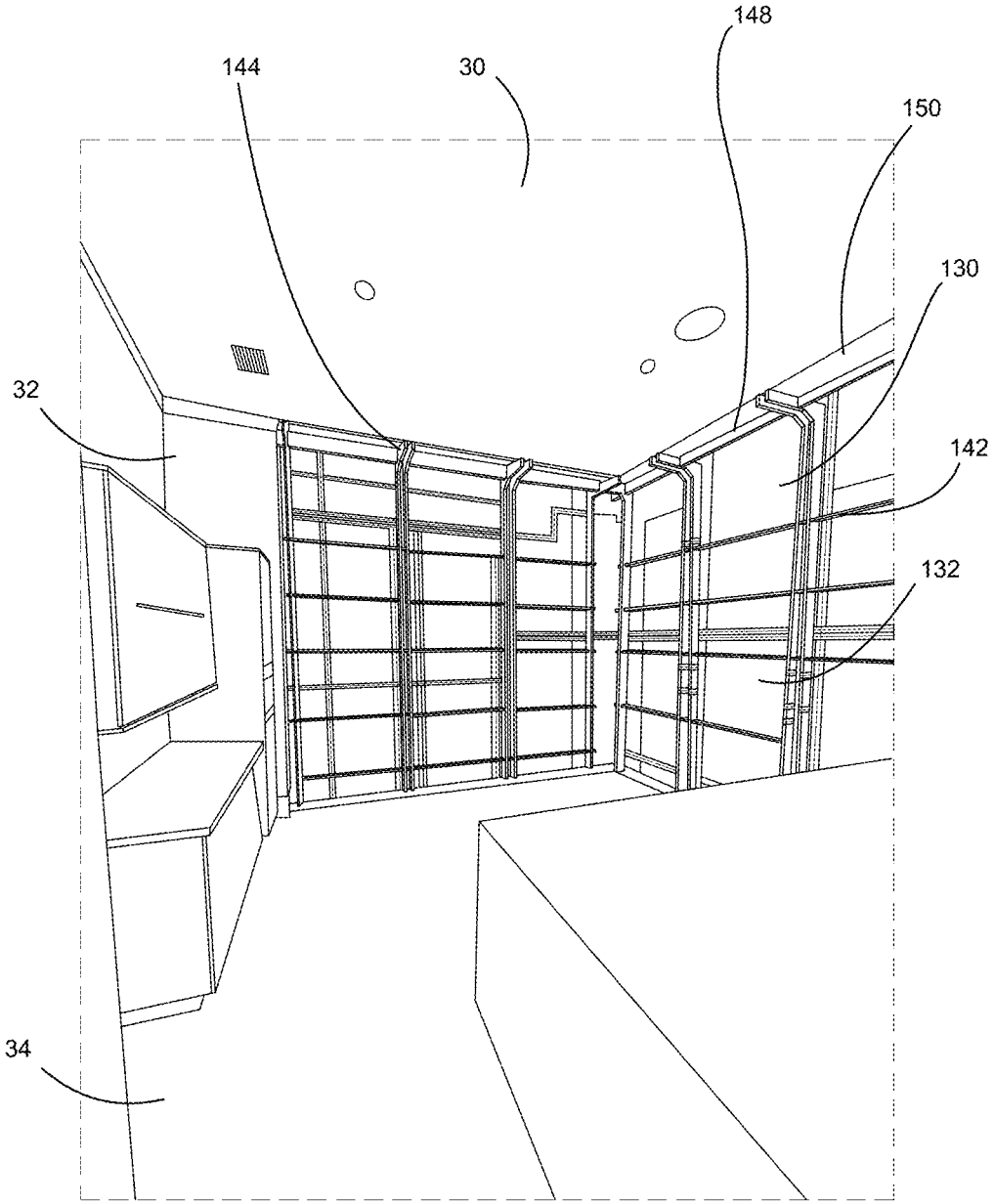
FIG. 14 illustrates a perspective view of a rear side of the system installed in a large room.

FIG. 1 illustrates a front view of various independent components of the system 100. FIG. 2 illustrates an isometric view of a full modular protection system 22 and staircase protection system 24. FIG. 3 illustrates an isometric exploded view of the staircase 14, stair treads 20 and risers 18, and the covering components: riser protector 118, tread covers 120, grip tapes 122, and stair cover anchors 124. FIG. 4 illustrates a conceptual view of the installation and assembly of the system 100. FIG. 5 illustrates a conceptual view of the installation and assembly of the system 100. FIG. 6 illustrates a conceptual view of the installation and assembly of the system 100. FIG. 7 illustrates a perspective view of the system 100 partially installed in a large room. FIG. 8 illustrates a perspective view of the system 100 partially installed in a large room. FIG. 9 illustrates a perspective view of the system 100 partially installed in a large room. FIG. 10 illustrates a perspective view of the system 100 installed in a large room. FIG. 11 illustrates a perspective view of the system 100 installed in a large room. FIG. 12 illustrates a perspective view of the system 100 installed in a large room. FIG. 13 illustrates an enlarged conceptual view of a unique configuration of components of the system 100 to integrate with structural and architectural features of a large room. FIG. 14 illustrates a perspective view of a rear side of the system 100 installed in a large room.

In an exemplary embodiment, a temporary protective containment barrier system 100 for use during construction and demolition is provided. The temporary protective containment barrier system 100 for use during construction and demolition includes a plurality of wall members 130. Each wall member 130 in the plurality of wall members includes at least one vertical wall panel 132 secured to an interior area 134 of a vertically adjustable stud member 136, thereby creating a vertical partition. The stud member may be adjusted vertically by separating a lower stud 138 and an upper stud 140, as may be appreciated in FIG. 1. Each vertically adjustable stud member 136 is connectable to a neighboring stud member by a plurality of noggings 142. The plurality of wall members 130 is comprised of a plurality of vertically adjustable stud members 136, each with an outward cantilever 144 integrated at an upper boundary 146, wherein the outward cantilever 144 extends perpendicularly away from each adjustable stud member 136 in a direction opposite of a side on which the at least one vertical wall panel 130 is secured to, as shown in FIG. 6. The system also includes a plurality of noggins 142 and at least one ceiling joist 148. Each outward cantilever 144 is connectable to a neighboring outward cantilever by at least one ceiling joist 148.

In some embodiments, a geometry of each nogging 142 is identical to a geometry of each ceiling joists 148 to provide for simplicity and interchangeability, as shown in FIG. 1, and as may be appreciated in FIGS. 5-7.

In some embodiments, the temporary protective containment barrier system for use during construction and demolition further includes at least one horizontal ceiling panel 150 secured to an exterior ceiling area of the plurality of wall members, as shown in FIGS. 6, 7, and 9.

In some embodiments, the temporary protective containment barrier system for use during construction and demolition further includes at least one horizontal floor panel 152 positioned perpendicularly at a lower boundary of the at least one vertical wall panel, as shown in FIG. 12.

In some embodiments, the temporary protective containment barrier system for use during construction and demolition further includes at least one vertical notch 154 with an upper opening 156 in each outward cantilever 144 (as shown in FIG. 4), and a vertical notch 158 at each distal end of each ceiling joist 148. Each vertical notch 158 has a lower opening 160. The at least one vertical notch 154 in the cantilever 144 is configured for complemental engagement with the vertical notch 158 in the ceiling joist 148, whereby each vertically adjustable stud member 136 is connectable to the neighboring stud member when each of the lower openings 160 of the vertical notches 158 of the ceiling joist 148 are slid down complemental notches with upper openings 156 of the outward cantilever 144, (see FIGS. 4-7).

In some embodiments of the temporary protective containment barrier system for use during construction and demolition, each vertically adjustable stud member 136 includes at least one horizontal notch 162 with an outer opening 164. Each nogging includes a horizontal notch 166 at each distal end, wherein each notch 166 has an inner opening 168. The at least one horizontal notch 162 of each of the vertically adjustable stud members 136 is configured for complemental engagement with the horizontal notch 166 in the nogging 142, whereby each vertically adjustable stud member 136 is connectable to the neighboring stud member when each of the inner openings 168 of the horizontal notches 166 of the noggings 142 are slid into complemental horizontal notches 162 with outer openings 164 of the vertically adjustable stud members 136.

In some embodiments, the temporary protective containment barrier system for use during construction and demolition further includes an adhesive seal element 170 applied between seams of individual components of the temporary protective containment barrier system (as shown in FIGS. 7 and 10-13) for use during construction and demolition, wherein the individual components include at least two components in the group comprising: at least one vertical wall panel 132, at least one ceiling panel 150, at least one horizontal floor panel 152, a pre-existing ceiling 30, a pre-existing wall 32, and a pre-existing floor 34 (as may be seen in FIG. 14). In some embodiments, the adhesive seal element 170 is an adhesive tape.

In some embodiments, the ceiling panels 150, wall panels 132, and floor panels 152 are constructed of a corrugated or fluted material thereby configuring the ceiling panels 150, wall panels 132, and floor panels 152 for cushion against impacting objects. In some embodiments, the corrugated or fluted material is a fluted plastic sheet.

In some embodiments, the ceiling joists 148, noggings 142, and vertically adjustable stud members 136 are also constructed of a corrugated or fluted material thereby configuring the ceiling joists 148, noggings 142, and vertically adjustable stud members 136 for cushion against impacting objects and structural strength. In some embodiments, the corrugated or fluted material is a fluted plastic sheet.

In some embodiments, each vertically adjustable stud member 136 includes: a vertical lower stud 138, and an independent and adjustably coupled vertical upper stud 140 with outward cantilever 144. FIG. 1 shows the vertical lower stud 138 and upper stud 140 independently. The combination of which may be seen in FIGS. 5-7.

In some embodiments of the temporary protective containment barrier system for use during construction and demolition, a door assembly 172 is provided, including a panel 174 comprised of a flexible plastic shroud forming a door body 176. This assembly includes a zipper opening 178 integrated within the flexible plastic shroud 180, and a zipper mechanism 182 operatively associated with the zipper opening 178 of the door body 176, wherein the zipper mechanism 182 is adapted to move along a defined path between a first edge 184 and a second edge 186, and wherein the zipper mechanism provides selective access through the door assembly, as may be seen in FIG. 11.

In another exemplary embodiments, a system of temporary protective containment for use during construction and demolition is disclosed, further including a temporary protection system 24 for a stair 14 and at least one free-standing tunnel module 22, as shown in FIGS. 2-3.

In some embodiments the temporary protection system 24 for a stair 14 comprises at least one temporary stair tread cover 120, constructed of fluted plastic. The system also includes at least one temporary stair riser protector 118, having a vertically oriented main body with two fold lines running parallel to a width of the main body, wherein once folded, a top folded flap 117 horizontally extends away from the main body, and a bottom folded flap 119 horizontally extends away from the main body in a direction opposite of the direction of the top folded flap, thereby creating an overlap between the top folded flap and an upper stair tread cover of the at least one stair tread cover and an overlap between the bottom folded flap and a lower stair tread cover of the at least one stair tread cover 120. At least a pair of stair anchors 124 is configured to directionally secure the stair tread cover 120, wherein each stair anchor 124 in the pair of stair anchors includes a vertical main body with a horizontal fold line, wherein once folded, a bottom folded flap 119 horizontally extends away from the main body and overlaps the stair tread cover.

In some embodiments, the system includes a plurality of frame members 188, including at least a first frame member and at least a second frame member, wherein each frame member 188 is a unitary frame element comprising a pair of opposing studs 190 and integrated top plate 192 connecting the pair of opposing studs at an upper integration point 194. The embodiment also includes a plurality of noggings 142 connecting a first stud of the pair of opposing studs of the first frame member in the plurality of frame members with a first stud of the pair of opposing studs of the second frame member in the plurality of frame members, as shown in FIG. 2, and a plurality of noggings 142 connecting a second stud of the pair of opposing studs of the first frame member in the plurality of frame members with a second stud of the pair of opposing studs of the second frame member in the plurality of frame members, thereby forming the at least one free-standing tunnel module 22. Further included is a plurality of ceiling joists 148 connecting the top plate 192 of each of the first frame members to a top plate of each of the second frame members, thereby securing the at least one free-standing tunnel module 22. The system also includes at least one vertical wall panel 132 secured to an exterior area of the at least one free-standing tunnel module 22, thereby vertically enclosing the at least one free-standing tunnel module 22, at least one horizontal ceiling panel 150 secured to an exterior ceiling area of the at least one free-standing tunnel module 22, and at least one horizontal floor panel 152, whereby the horizontal ceiling panel 150 and the floor panel 152 horizontally enclose the at least one free-standing tunnel module 22.

It is to be appreciated that many of the exemplary embodiments use the same components for different features. For example, the tunnel modules include a U-shaped frame element, however, this frame element may be split at the top plate to create the cantilever of the wall partition structure. The noggings and ceiling joists are typically identical and interchangeable for ease of construction. The floor panels, wall panels, and ceiling panels may all be interchangeable to allow for less components to transport and maximum use as well as interchangeability. While some figures, such as FIG. 1, show an independent ceiling panel and wall panel, it should be appreciated that a ceiling panel may be a wall panel cut down to size.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. A temporary protective containment barrier system for use during construction and demolition, comprising:

a plurality of wall members;

each wall member in said plurality of wall members includes at least one vertical wall panel secured to an interior area of a vertically adjustable stud member, thereby creating a vertical partition;

said plurality of wall members is comprised of a plurality of said vertically adjustable stud members, each with an outward cantilever integrated at an upper boundary, wherein said outward cantilever extends perpendicularly away from each adjustable stud member in a direction opposite of a side on which said at least one vertical wall panel is secured to;

a plurality of noggings;

each vertically adjustable stud member in said plurality of vertically adjustable stud members is connectable to a neighboring stud member by said plurality of noggings; and at least one ceiling joist;

each outward cantilever in said plurality of vertically adjustable stud members is connectable to a neighboring outward cantilever by said at least one ceiling joist.

2. The temporary protective containment barrier system for use during construction and demolition, as recited in claim 1, further comprising:

at least one horizontal ceiling panel secured to an exterior ceiling area of said plurality of wall members.

3. The temporary protective containment barrier system for use during construction and demolition, as recited in claim 1, further comprising:

at least one horizontal floor panel positioned perpendicularly at a lower boundary of said at least one vertical wall panel.

4. The temporary protective containment barrier system for use during construction and demolition, as recited in claim 1, further comprising:

each said outward cantilever includes at least one vertical notch with an upper opening;

each said ceiling joist includes a vertical notch at each distal end, wherein each vertical notch has a lower opening; and said at least one vertical notch of each of said outward cantilever is configured for complemental engagement with said vertical notch in said ceiling joist, whereby each vertically adjustable stud member is connectable to said neighboring stud member when each of said lower openings of said vertical notches of said ceiling joist are slid down complemental notches with upper openings of said outward cantilever.

5. The temporary protective containment barrier system for use during construction and demolition, as recited in claim 1, further comprising:

each said vertically adjustable stud member includes at least one horizontal notch with an outer opening;

each said nogging includes a horizontal notch at each distal end, wherein each notch has an inner opening; and said at least one horizontal notch of each of said vertically adjustable stud members is configured for complemental engagement with said horizontal notch in said nogging, whereby each vertically adjustable stud member is connectable to said neighboring stud member when each of said inner openings of said horizontal notches of said noggings are slid into complemental horizontal notches with outer openings of said vertically adjustable stud members.

6. The temporary protective containment barrier system for use during construction and demolition, as recited in claim 1, further comprising:

an adhesive seal element applied between seams of individual components of the temporary protective containment barrier system for use during construction and demolition, wherein said individual components include at least two components in the group comprising:

said at least one vertical wall panel;

at least one ceiling panel;

at least one horizontal floor panel;

a pre-existing ceiling;

a pre-existing wall;

a pre-existing floor; and wherein said adhesive seal element is an adhesive tape.

7. The temporary protective containment barrier system for use during construction and demolition, as recited in claim 1, wherein a geometry of each nogging is identical to a geometry of each ceiling joists to provide for simplicity and interchangeability.

8. The temporary protective containment barrier system for use during construction and demolition, as recited in claim 1, wherein each of said vertically adjustable stud members includes:

a vertical lower stud; and an independent and adjustably coupled vertical upper stud with said outward cantilever.

9. The temporary protective containment barrier system for use during construction and demolition, as recited in claim 1, further comprising:

a door assembly including a panel comprised of a flexible plastic shroud forming a door body;

a zipper opening integrated within said flexible plastic shroud; and a zipper mechanism operatively associated with the zipper opening of the door body, wherein the zipper mechanism is adapted to move along a defined path between a first edge and a second edge, and wherein said zipper mechanism provides selective access through the door assembly.

10. The temporary protective containment barrier system for use during construction and demolition, as recited in claim 1, wherein ceiling panels, said wall panels, and floor panels are constructed of a corrugated or fluted material thereby configuring said ceiling panels, said wall panels, and said floor panels for cushion against impacting objects.

11. The temporary protective containment barrier system for use during construction and demolition, as recited in claim 10, wherein the corrugated or fluted material is a fluted plastic sheet.

12. The temporary protective containment barrier system for use during construction and demolition, as recited in claim 1, wherein said ceiling joists, said noggings, and said vertically adjustable stud members are constructed of a corrugated or fluted material thereby configuring said ceiling joists, said noggings, and said vertically adjustable stud members for cushion against impacting objects and structural strength.

13. The temporary protective containment barrier system for use during construction and demolition, as recited in claim 12, wherein the corrugated or fluted material is a fluted plastic sheet.

14. A system of temporary protective containment for use during construction and demolition, comprising:

a plurality of wall members;

each wall member in said plurality of wall members includes at least one vertical wall panel secured to an interior area of a vertically adjustable stud member, thereby creating a vertical partition;

said plurality of wall members is comprised of a plurality of said vertically adjustable stud members, each with an outward cantilever integrated at an upper boundary, wherein said outward cantilever extends perpendicularly away from each adjustable stud member in a direction opposite of a side on which said at least one vertical wall panel is secured to;

each vertically adjustable stud member in said plurality of vertically adjustable stud members is connectable to a neighboring stud member by a plurality of noggings;

each outward cantilever in said plurality of vertically adjustable stud members is connectable to a neighboring outward cantilever by at least one ceiling joist;

at least one horizontal floor panel positioned perpendicularly at a lower boundary of said at least one vertical wall panel;

at least one free-standing tunnel module, comprising a plurality of frame members, at least one tunnel wall panel secured to an exterior wall area of the frame members, at least one tunnel ceiling panel secured to an exterior ceiling area of the frame members and at least one tunnel floor panel defining a tunnel floor surface, wherein said at least one tunnel ceiling panel and said at least one tunnel floor panel horizontally enclose said tunnel module and said at least one tunnel wall panel vertically encloses said tunnel module; and a temporary stair protection system configured to provide a protective barrier for a stairwell enclosed by said tunnel module, said stair protection system comprising at least one temporary stair tread cover, at least one temporary stair riser protector and at least a pair of stair anchors.

15. The system of temporary protective containment for use during construction and demolition, as recited in claim 14, wherein the temporary stair protection system further comprises:

said at least one temporary stair tread cover constructed of fluted plastic;

said at least one temporary stair riser protector, having a vertically oriented main body with two fold lines running parallel to a width of the main body, wherein once folded, a top folded flap horizontally extends away from the main body, and a bottom folded flap horizontally extends away from the main body in a direction opposite of a direction of the top folded flap, thereby creating an overlap between said top folded flap and an upper stair tread cover of said at least one stair tread cover and an overlap between said bottom folded flap and a lower stair tread cover of said at least one stair tread cover; and said at least a pair of stair anchors configured to directionally secure the stair tread cover, wherein each stair anchor in said pair of stair anchors includes a vertical main body with a horizontal fold line, wherein once folded, a bottom folded flap horizontally extends away from the main body and overlaps said stair tread cover.

16. The system of temporary protective containment for use during construction and demolition, as recited in claim 14, wherein the at least one free-standing tunnel module further comprises:

said plurality of frame members including at least a first frame member and at least a second frame member, wherein each frame member in said plurality of frame members is a unitary frame element comprising a pair of opposing studs and integrated top plate connecting said pair of opposing studs at an upper integration point;

a plurality of first noggings connecting a first stud of said pair of opposing studs of said first frame member in said plurality of frame members with a first stud of said pair of opposing studs of said second frame member in said plurality of frame members, and a plurality of second noggings connecting a second stud of said pair of opposing studs of said first frame member in said plurality of frame members with a second stud of said pair of opposing studs of said second frame member in said plurality of frame members, thereby forming said at least one free- standing tunnel module; and a plurality of ceiling joists connecting said top plate of each of said first frame members to a top plate of each of said second frame members, thereby securing said at least one free- standing tunnel module.

17. The temporary protective structural system, as recited in claim 14, wherein a geometry of each nogging is identical to a geometry of each ceiling joists to provide for simplicity and interchangeability.

18. The temporary protective structural system, as recited in claim 14, wherein an adhesive tape seals seams between panels, including seams existing between one or more of said ceiling panels, said wall panels, and said floor panels when multiple panels are incorporated, and said tape seals seams between said free-standing tunnel modules when multiple free-standing tunnel modules are incorporated.

19. The temporary protective structural system, as recited in claim 14, wherein said ceiling panels, said wall panels, and said floor panels are constructed of a corrugated or fluted material thereby configuring said ceiling panels, said wall panels, and said floor panels for cushion against impacting objects.

20. The temporary protective structural system, as recited in claim 19, wherein the corrugated or fluted material is a fluted plastic sheet.

21. The temporary protective structural system, as recited in claim 14, wherein said ceiling joists, said noggings, and said frame members are constructed of a corrugated or fluted material thereby configuring said ceiling joists, said noggings, and said frame members for cushion against impacting objects and structural strength.

22. The temporary protective structural system, as recited in claim 21, wherein the corrugated or fluted material is a fluted plastic sheet.

* * * * *